US010143044B1

(12) United States Patent
Lovens et al.

(10) Patent No.: US 10,143,044 B1
(45) Date of Patent: Nov. 27, 2018

(54) ELECTRIC INDUCTION HEATING OF STRIP OR SLAB MATERIAL

(71) Applicant: INDUCTOTHERM CORP., Rancocas, NJ (US)

(72) Inventors: Jean Lovens, Embourg (BE); Michel Fontaine, Aywaille (BE)

(73) Assignee: Inductotherm Corp., Rancocas, NJ (US)

( * ) Notice: Subject to any disclaimer, the term of this patent is extended or adjusted under 35 U.S.C. 154(b) by 13 days.

(21) Appl. No.: 15/270,494

(22) Filed: Sep. 20, 2016

Related U.S. Application Data

(60) Provisional application No. 62/221,396, filed on Sep. 21, 2015.

(51) Int. Cl.
*H05B 6/10* (2006.01)
*H05B 6/36* (2006.01)
*H05B 6/40* (2006.01)

(52) U.S. Cl.
CPC ..... *H05B 6/40* (2013.01); *H05B 6/101* (2013.01)

(58) Field of Classification Search
CPC ..... H05B 6/04; H05B 6/101; H05B 6/104; H05B 6/36; H05B 6/362; H05B 6/365; H05B 6/40
USPC ..... 219/635–637, 660–662, 645, 646, 671, 219/672, 673
See application file for complete search history.

(56) References Cited

U.S. PATENT DOCUMENTS 5,317,121 A * 5/1994 Katayama ..... H05B 6/36 219/672
6,107,613 A * 8/2000 Welch ..... H05B 6/36 219/672
6,963,056 B1 * 11/2005 Peysakhovich ..... H05B 6/104 219/645
2009/0255924 A1 * 10/2009 Lovens ..... H05B 6/104 219/645
2010/0080259 A1 * 4/2010 Lovens ..... H05B 6/104 373/152

* cited by examiner

*Primary Examiner* — Hung D Nguyen
(74) *Attorney, Agent, or Firm* — Philip O. Post

(57) ABSTRACT

A rectangular sheet heating inductor or a multi-turn inductor is provided for induction heat treatment of a strip or slab material that may require a change in the interior opening of the inductor to allow an abnormal region of the material to pass through the interior opening and/or to allow a change in a dimension of the inductor to achieve impedance load matching with a material having variable electromagnetic properties such as a multiphase steel.

14 Claims, 20 Drawing Sheets

ELECTRIC INDUCTION HEATING OF STRIP OR SLAB MATERIAL

CROSS REFERENCE TO RELATED APPLICATIONS

This application claims the benefit of U.S. Provisional Application No. 62/221,396, filed Sep. 21, 2015, which is hereby incorporated by reference in its entirety.

FIELD OF THE INVENTION

The present invention relates to electric induction heating of an electrically conductive strip or slab material with a generally rectangular sheet inductor or a multi-turn inductor particularly in applications where the dimensions of the electrically conductive material requires the cross sectional opening within the inductor to dynamically vary as the material passes through the inductor. The requirement for the dynamic change in the cross sectional opening may be based upon an abnormal region of the material, such as a curved strip or slab end, or a change in cross sectional thickness of the material, or a change in the electromagnetic properties of the material, or a combination of both an abnormal region of the material and varying electromagnetic properties of the material.

BACKGROUND OF THE INVENTION

In industrial induction heat processing of a strip material or slab material, the fixed interior heating cross sectional opening of a rectangular sheet inductor or a multi-turn inductor through which the material passes is sized to achieve a required process level of induced material heating. The strip or slab material may have an abnormal region, for example, where the leading (head) or trailing (tail) of the strip or slab is either not flat (that is, curved upward or downward) or the cross sectional thickness of the material is greater than the interior heating cross sectional opening of the inductor. For example as shown in FIG. 1(*a*) the abnormal region is the head end 90*a* of the material 90 (with normally constant thickness $z_3$) curved upward to prevent passage of the material into the interior of inductor 11 with fixed cross sectional interior height $z_2$ and positioned relative to the height of the curved head end of the material so that the curved head end would collide with the inductor and not pass within the inductor. An example of an abnormal region is shown in FIG. 1(*b*) and FIG. 1(*c*) where the abnormal region is the head end 90*b* of the material 90 having a maximum head end 90*b* thickness of $z_1$ while the interior height $z_2$ (in the Z-direction) of the required interior heating cross sectional opening $z_2$ of rectangular sheet inductor 11 is less than $z_1$ but greater than $z_3$ which is the normally constant thickness of the strip or slab region to be induction heat treatment. In both examples the interior cross sectional opening of the inductor would be fixed for efficient induction heating of the material passing through the inductor. Therefore there is the need for a rectangular sheet inductor or a multi-turn inductor that can have a temporarily extendible cross sectional interior opening to allow an abnormal region of the material to pass through the inductor with return to a smaller interior cross sectional opening for efficient induction heating of the material outside of the abnormal region particularly in industrial processes where multiple strips or slabs are sequentially passing through the inductor.

In addition to the requirement to allow an abnormal region of the material to pass through the inductor, in some industrial induction heat processing of a strip or slab material such as a multiphase steel composition (for example dual phase steels, transformation induced plasticity (TRIP) steels, ferrite-bainite (FB) steels and complex phase (CP) steels) where the impedance of the (load) material varies as it passes through the rectangular sheet inductor or a multi-turn inductor, there is a need for load impedance match with the output of the induction power source supplying power to the inductor. Therefore there is the need for a rectangular sheet inductor or a multi-turn inductor that has an extendible cross sectional opening of the rectangular sheet inductor or a multi-turn inductor to allow an abnormal region of the material to pass through the inductor and to return to a smaller interior heating cross sectional opening and, either alternatively, or in combination therewith, to match load impedance of a material with varied electromagnetic properties by varying the cross sectional opening of the rectangular sheet inductor or a multi-turn inductor as the material passes through the inductor particularly when multiple strips or slabs are sequentially passing through the inductor and the change in the material's electromagnetic properties are randomly variable as the material passes through the inductor.

Where there is an industrial induction heating process that requires both increasing the interior cross sectional opening of the inductor for passage of an abnormal region of the material, and changing the interior cross sectional opening for variable load impedance matching there is the need for a rectangular sheet inductor or a multi-turn inductor to have separate features for performing each of these two functions.

BRIEF SUMMARY OF THE INVENTION

In one aspect the present invention is an apparatus for, and method of, inductively heat treating a strip or slab material with a rectangular sheet inductor or a multi-turn inductor that requires enlargement of the interior cross sectional opening of the inductor to permit an abnormal region of the material to pass through the inductor and return to the inductor's heat treatment interior cross sectional opening when induction heat treating a heat treatment region of the material passing through the inductor's opening. The top inductor section or the bottom inductor section, or both the top and bottom inductor sections are moved away from the surface of the material passing through the interior of the inductor by sliding extension of the opposing sides of the top and/or bottom inductor(s) to allow the abnormal region of the material to pass through the inductor and sliding retraction of the opposing sides of the top and/or bottom inductor(s) to return to the inductor's interior heating cross sectional opening to inductively heat treat the material as it passes through the inductor.

In another aspect the present invention is an apparatus for, and method of, inductively heat treating a strip or slab material with a rectangular sheet inductor or a multi-turn inductor that requires enlargement of the interior cross sectional opening of the inductor to permit an abnormal region of the material to pass through the inductor and return to a different interior cross sectional opening when induction heat treating a heat treatment region of the material to pass within the inductor's opening. The top inductor section and the bottom inductor section can be spread apart from each other to allow the abnormal region of the material to pass through the inductor. If the material has varying electromagnetic properties the top inductor section or the bottom inductor section, or both the top and bottom inductor sections can be moved away from, or toward, the surface of the material passing through the inductor by sliding extension, or retraction of the opposing sides of the top and/or bottom inductor(s) to match inductive power output impedance to the variable load impedance of the material as it passes through the inductor.

The above and other aspects of the invention are set forth in this specification and the appended claims.

BRIEF DESCRIPTION OF THE DRAWINGS

The foregoing brief summary, as well as the following detailed description of the invention, is better understood when read in conjunction with the appended drawings. For the purpose of illustrating the invention, there is shown in the drawings exemplary forms of the invention that are presently preferred; however, the invention is not limited to the specific arrangements and instrumentalities disclosed in the following appended drawings.

FIG. 1(*b*) and FIG. 1(*c*) illustrate a strip or slab material with a variable cross sectional thickness at the beginning or end region of the material that decreases to a constant heat treatment cross sectional thickness for the remainder of the material passing through the inductor.

FIG. 3(*b*) is a cross sectional elevation detail of one end of the inductor shown in FIG. 2 in a partially extended position between the closed (fully retracted) and the opened (fully extended position).

FIG. 6(*b*) is a perspective view of the inductor shown in FIG. 2 with the moving top inductor section shown in a closed (fully retracted) position.

FIG. 8(*b*) is a perspective view of an improvement to the apparatus shown in FIG. 8(*a*) with the coil modified to a multi-turn rectangular sheet inductor 101 of the present invention with a moveable top inductor section shown in the closed (fully retracted position).

FIG. 8(*c*) is a perspective view of the inductor shown in FIG. 8(*b*) in an inductor open position.

FIG. 11(*b*) is a cross sectional elevation of the inductor shown in FIG. 11(*a*).

FIG. 11(*c*) is a perspective view of the inductor shown in FIG. 11(*b*).

DETAILED DESCRIPTION OF THE INVENTION

In some applications of the present invention, a strip or slab material is defined herein as an electrically conductive material with an abnormal region and/or electromagnetic properties that may vary as the strip or slab material passes through a rectangular sheet inductor of one or more turns in an induction heating process, for example, for reheating the material before treatment in another industrial process, for example, forging after exit from the inductor. For convenience use of the term "material" herein is used to include both strip and slab materials and the term "variable material parameter" is used to describe the abnormal region or variable electromagnetic properties of the material. The rectangular sheet inductor can be formed from an electrically conductive material such as copper or a copper alloy and can be suitably connected to a source of alternating current to provide electric power for induction heating of the material as the material passes through the interior opening of the inductor.

Figures 1A, 1B, 1C:
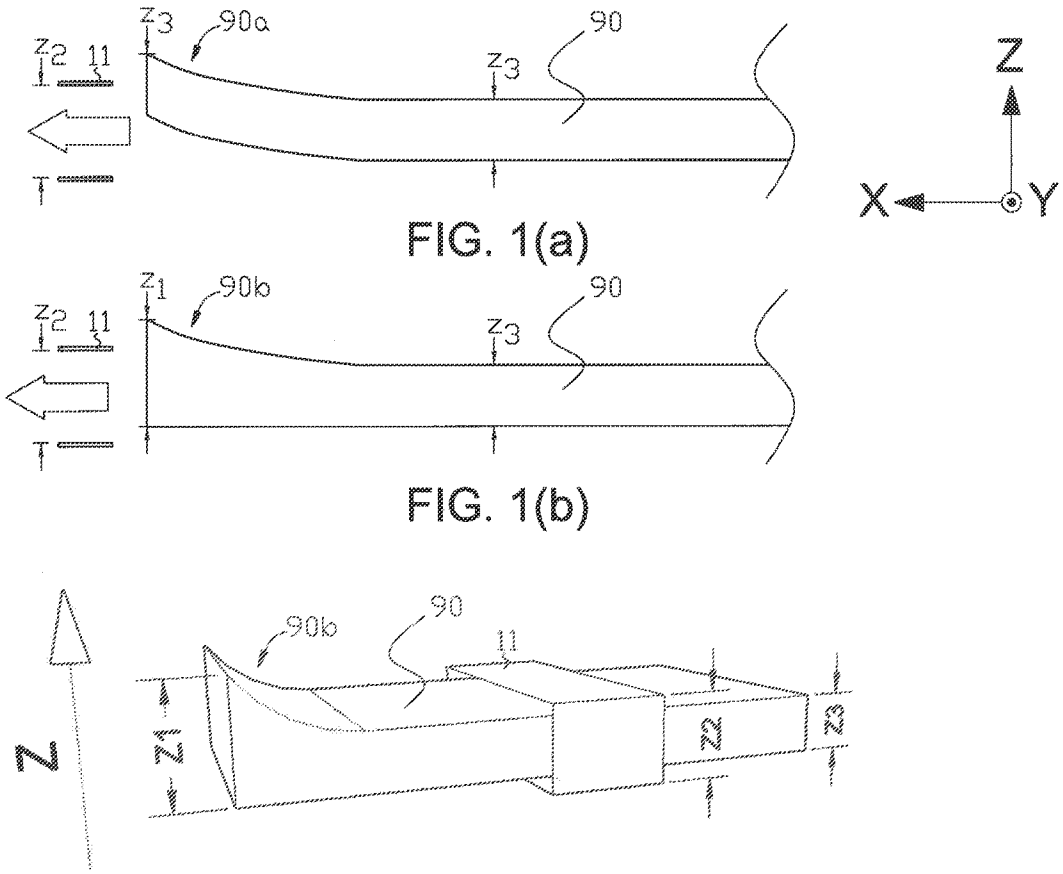
FIG. 1(*a*) illustrates a strip or slab material with a curved leading end at the beginning of the material before it enters a rectangular sheet inductor.

FIG. 2 to FIG. 6(*b*) illustrate one example of a rectangular sheet inductor 100 of the present invention that can accommodate induction heating of a strip or slab material with an abnormal region as shown, for example, in FIG. 1(*a*) through FIG. 1(*c*).

Figure 2:
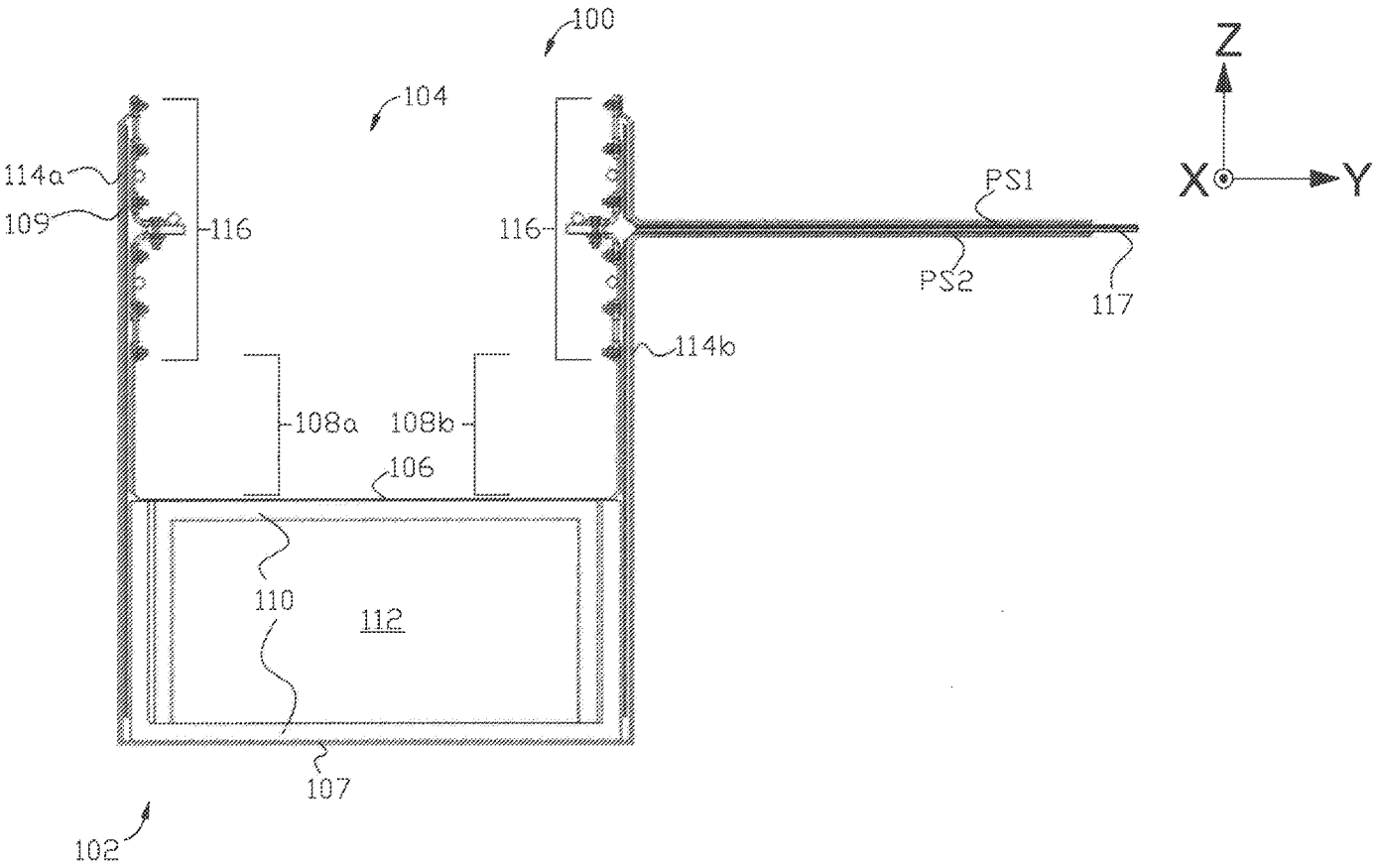
FIG. 2 is a cross sectional elevation of one example of a rectangular sheet inductor of the present invention shown in the closed (fully retracted) position with minimum separation between the top and bottom inductor sections.
Figure 3A:
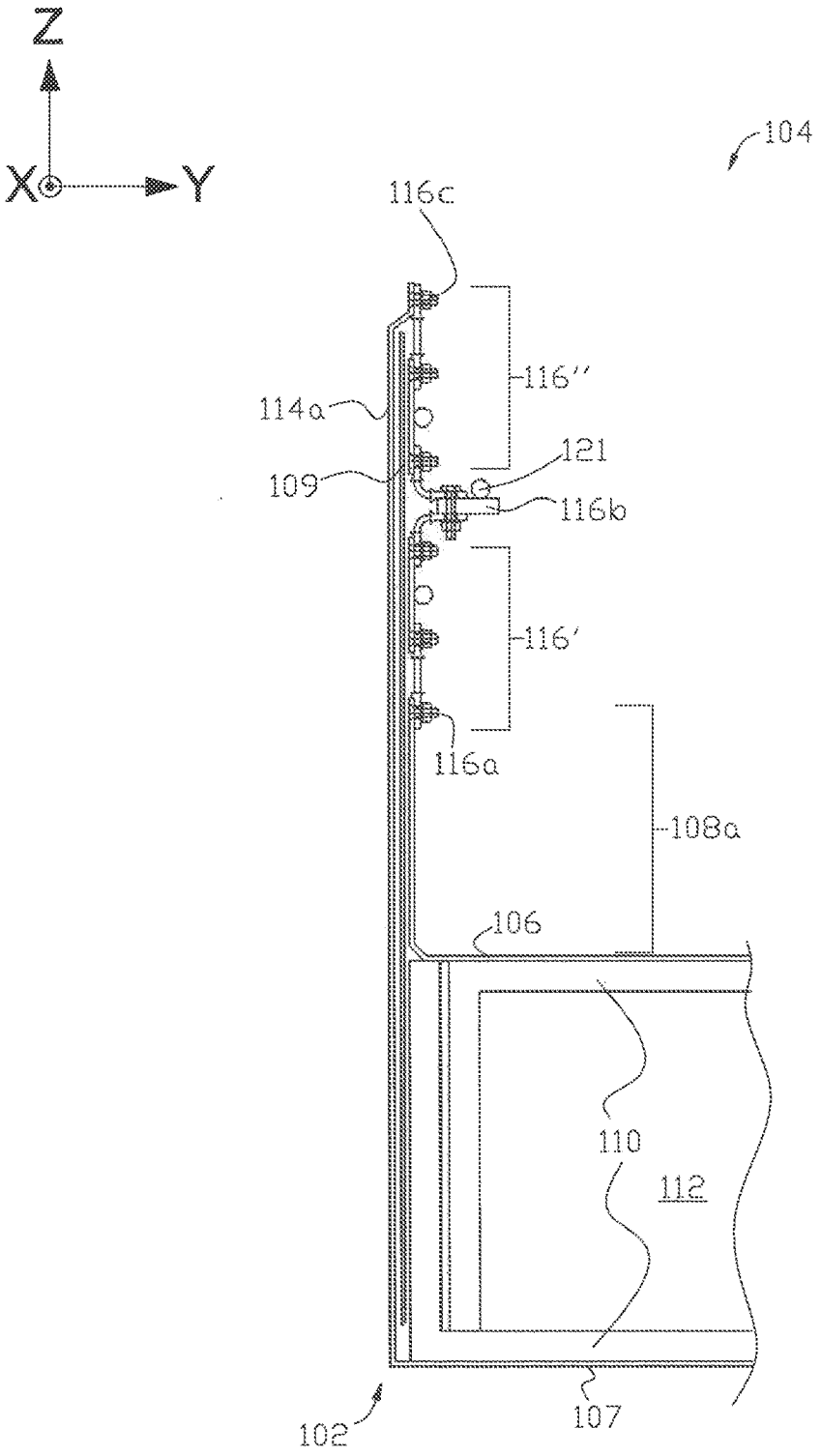
FIG. 3(*a*) is a cross sectional elevation detail of one end of the inductor shown in FIG. 2 in the fully retracted position.
Figure 3B:
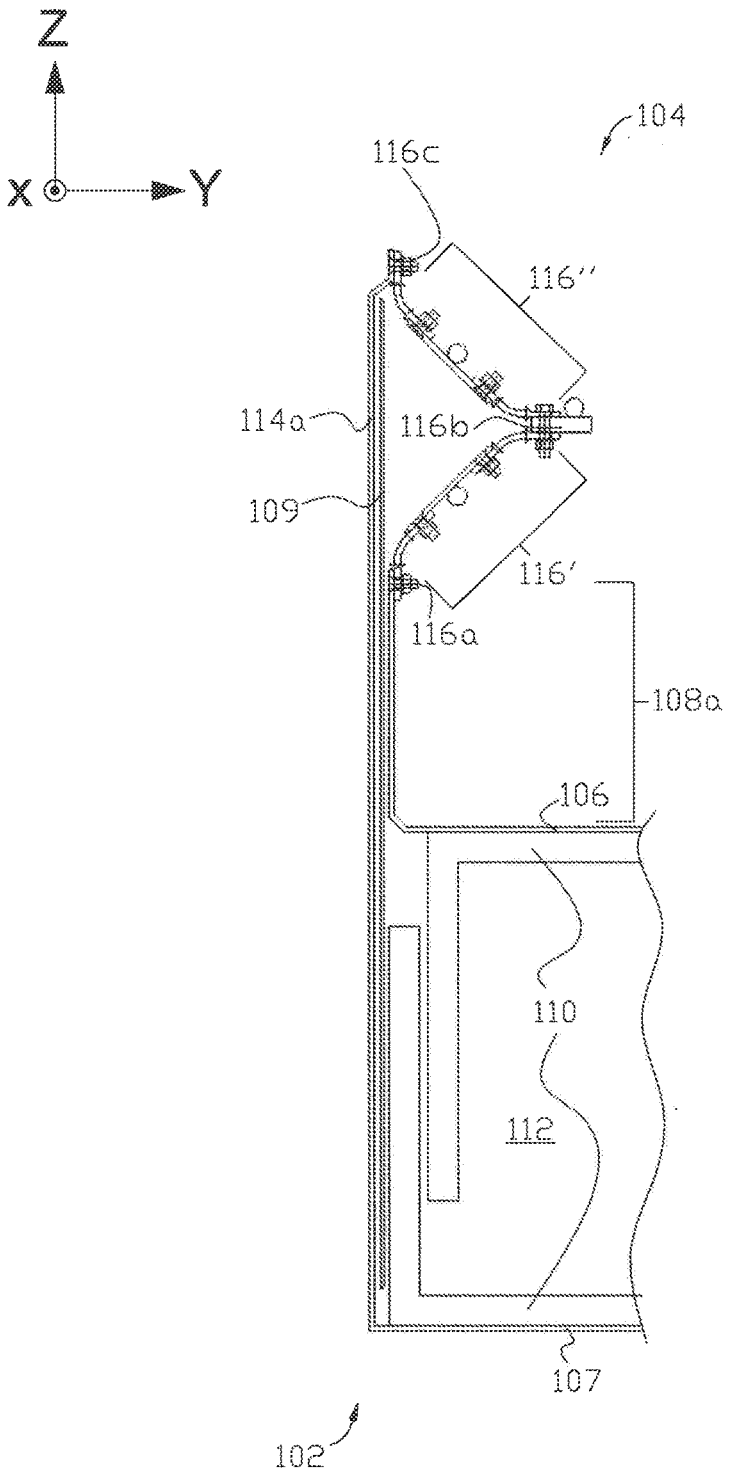

FIG. 3(*a*) and FIG. 3(*b*) are detailed partial views of one end of rectangular sheet inductor 100 showing fixed inductor sections 102 and movable inductor sections 104 where the fixed inductor sections 102 comprise bottom inductor section 107 and outer fixed side inductor sections 114*a* and 114*b* as also shown, for example, in FIG. 2.

In this embodiment of the invention moveable inductor sections 104 comprise one longer length side of the rectangular inductor that can be referred to as top inductor section 106 and inner moveable side inductor sections 108*a* and 108*b* that are respectively electrically continuous with the opposing ends of top inductor section 106 as shown in the figures. Each outer fixed side inductor section 114*a* or 114*b* is electrically connected to its corresponding inner moveable side inductor section 108*a* or 108*b* by an inductor side extension/retraction apparatus 116. Electrical insulation 109 that may be an electrical insulating material such as mica or electrical insulating medium such as air or other dielectric material is positioned between outer fixed sheet inductor side sections 114*a* and 114*b*, and inner moveable side inductor sections 108*a* and 108*b* and the inductor extension/retraction apparatus 116 on the adjustable first and second opposing sides of inductor 100.

Alternatively rectangular sheet inductor 100 can be described as being formed from a fixed sheet inductor side 107 opposing a moveable sheet inductor side 106 and adjustable first and second opposing sides with each adjustable opposing side formed from an outer fixed sheet inductor section 114*a* or 114*b* and an inner moveable sheet inductor section 108*a* or 108*b* with each fixed sheet inductor section joined to its respective moveable sheet inductor section by an inductor side extension/retraction apparatus 116. Provision is made in inductor 100 for connection to an alternating current power source. The first ends of the outer fixed sheet inductor sections 114*a* or 114*b* are suitably connected to the opposing ends of the fixed inductor side 107 and the first ends of the inner moveable sheet inductor sections 108*a* and 108*b* are suitably connected to the opposing ends of the moveable sheet inductor side 106. The fixed sheet inductor side 107 and the inner moveable sheet inductor sections 108*a* and 108*b* may be fabricated from a continuous electrically conductive sheet that is bended at connecting ends of fixed sheet inductor side 107 and inner moveable sheet inductor sections 108*a* and 108*b* to the shape shown in the drawings. The moveable sheet inductor side 106 and the inner moveable sheet inductor sections 108*a* and 108*b* may be fabricated from a continuous electrically conductive sheet that is bended at connecting ends of moveable sheet inductor side 106 and inner moveable sheet inductor sections 108*a* and 108*b* to the shape shown in the drawings.

In one embodiment of the invention thermal insulation 110 is provided on the interior of the fixed and moveable inductor sections to thermally insulate the interior inductor furnace walls that form furnace interior volume 112 through which strip or slab material 90 passes through as the moveable top inductor section 106 moves from a closed (fully retracted) position, through the partially extended positions, and the opened (fully extended) position. As shown in the figures in one embodiment of the invention two opposing "U" shaped thermal insulation sections are provided with the upper insulation attached to the interior of moveable sheet inductor side 106 and lower insulation attached to the interior of fixed sheet inductor side 107.

In some embodiments of the invention, the thermal insulation may comprise a folding thermal insulation material where the folds expand as the inductor furnace transitions from the closed position to the opened position to maintain insulation around the entire furnace volume.

Figure 4:
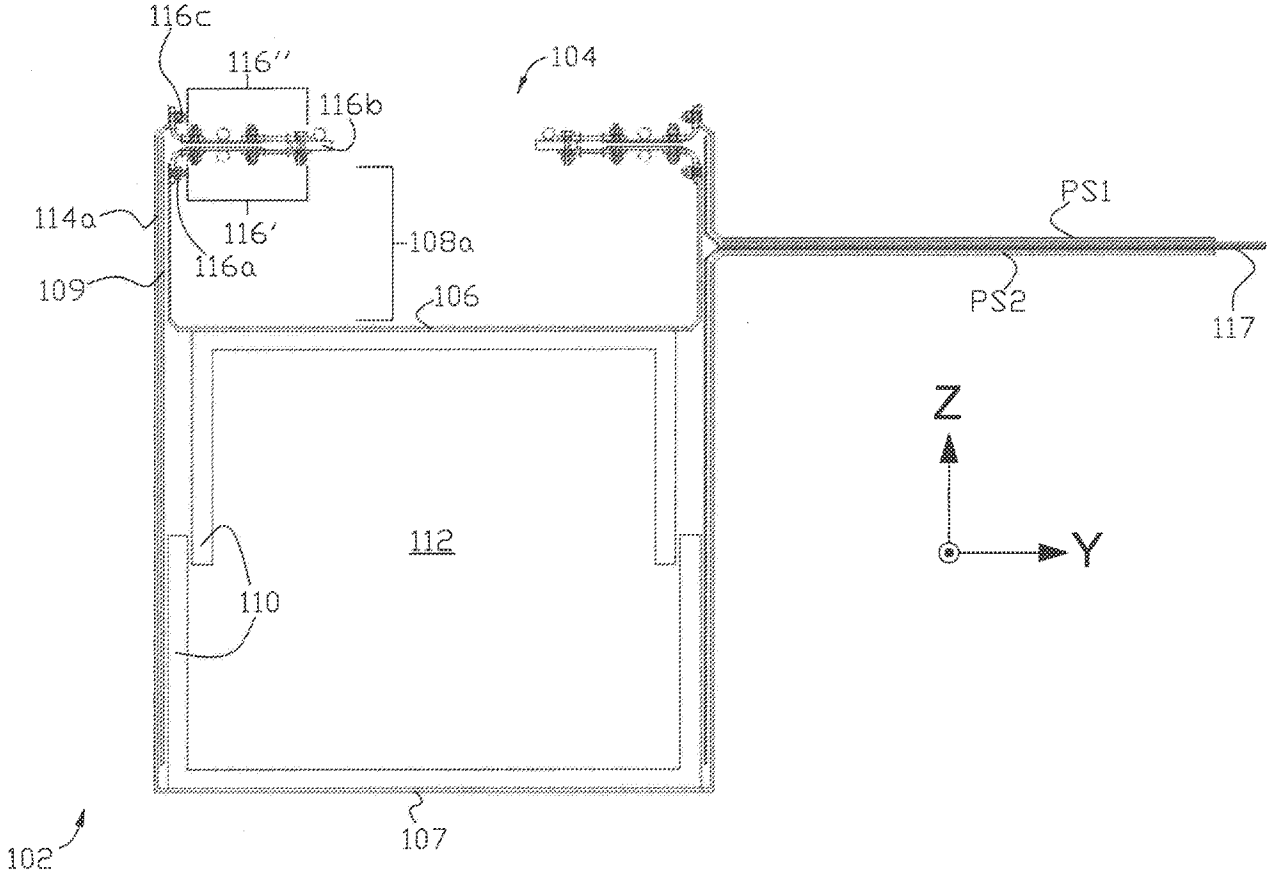
FIG. 4 is a cross sectional elevation of the inductor shown in FIG. 2 in the opened (fully extended) position.
Figure 5:
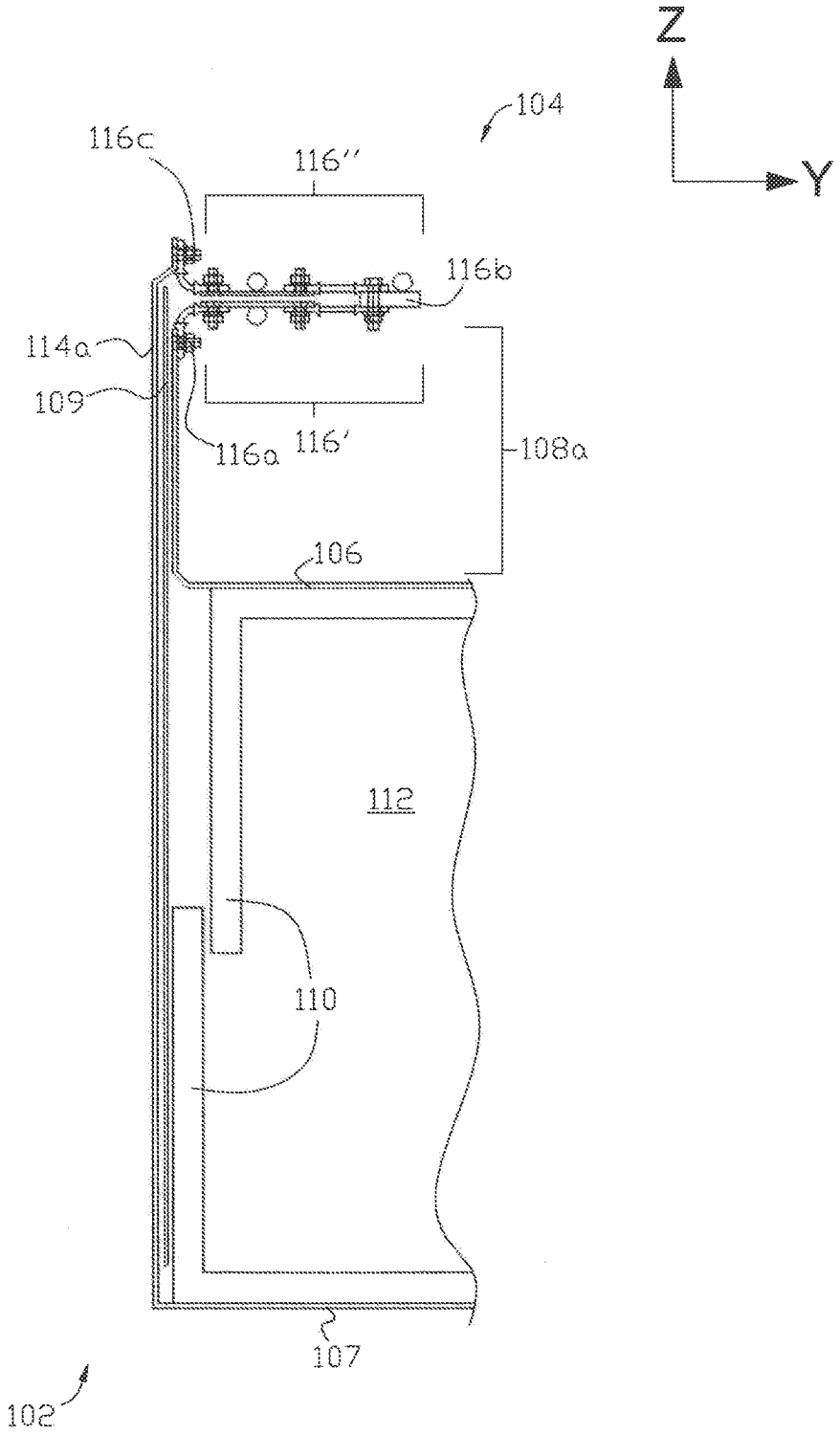
FIG. 5 is a cross sectional elevation detail of one end of the inductor shown in FIG. 4 in the fully extended positon.
Figure 6A:
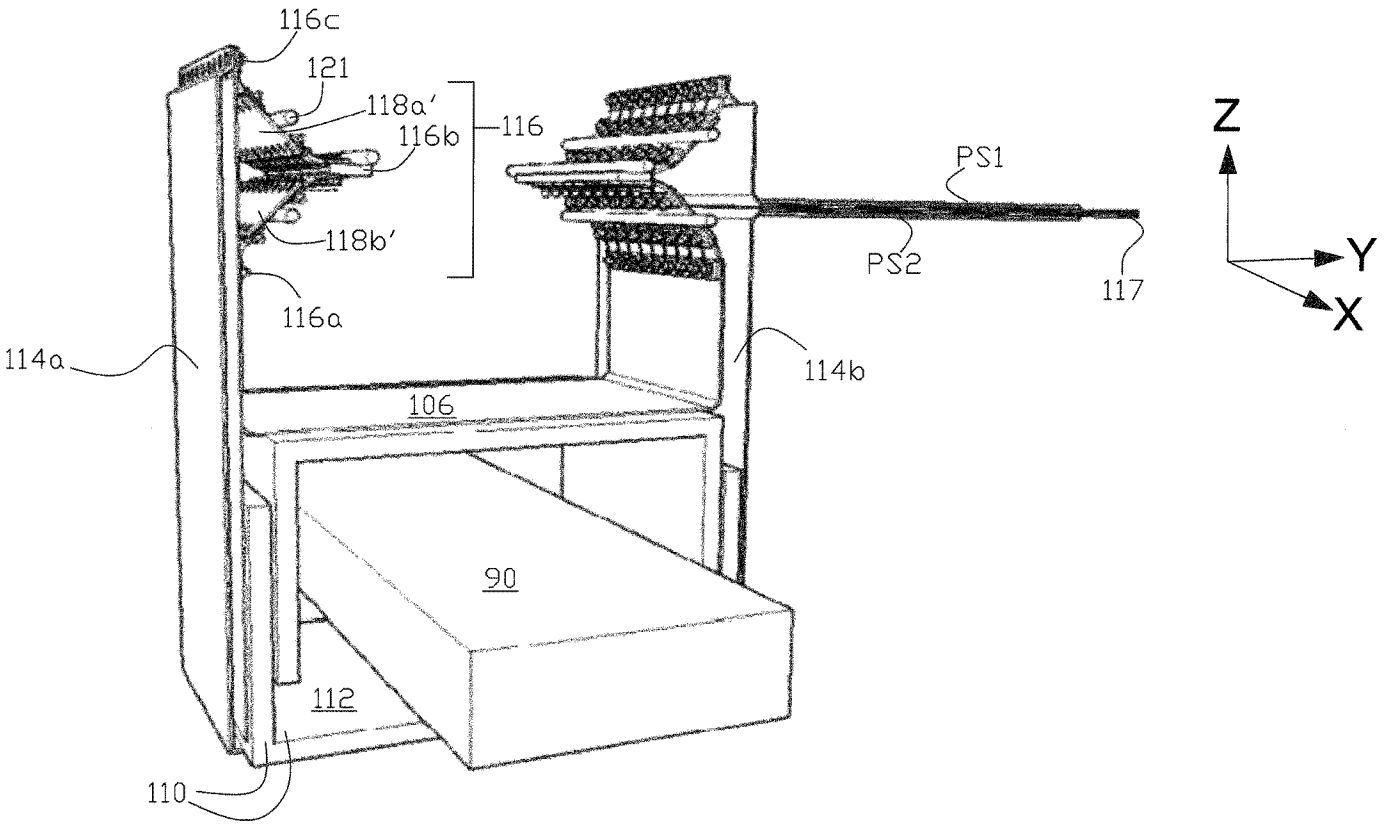
FIG. 6(*a*) is a perspective view of the inductor shown in FIG. 2 with the moving top inductor section shown in a partially extended position as also shown in FIG. 3(*b*).
Figure 6B:
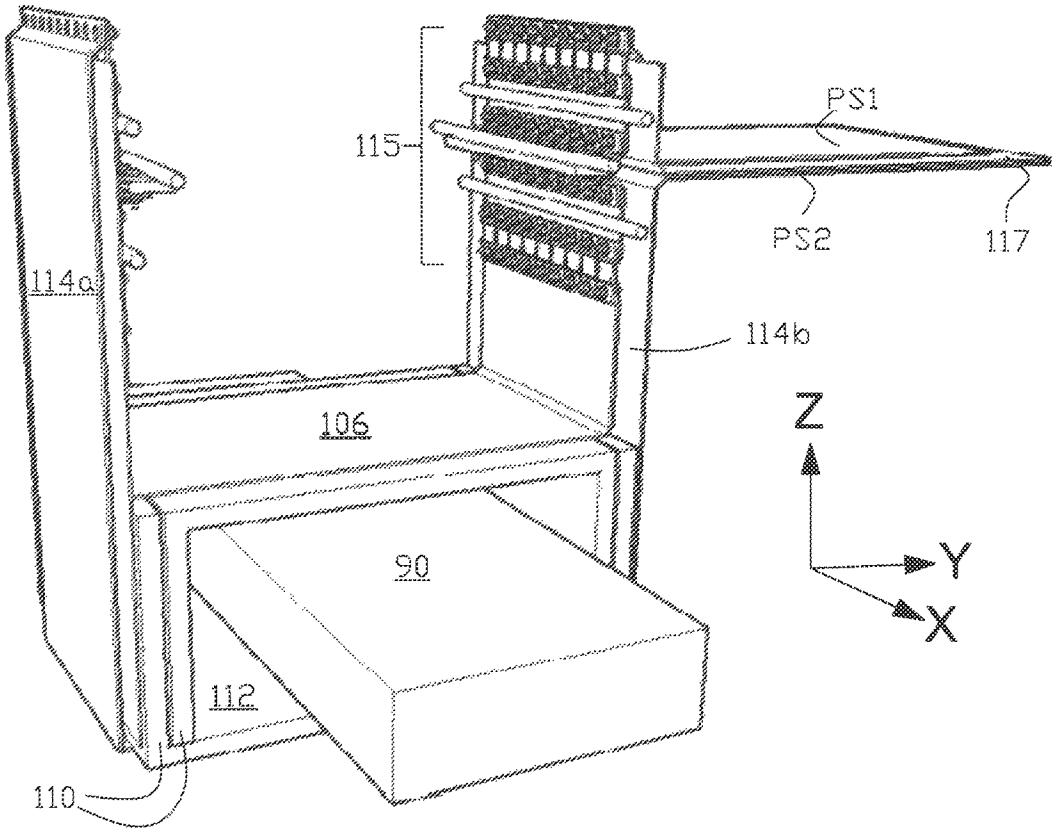

In one embodiment of the invention inductor extension/retraction apparatus 116 comprises a triple-hinged flexible electrically conductive apparatus that has hinged flexible inductor joints 116*a*, 116*b* and 116*c* so that when each side inner moveable sheet inductor section (108*a* and 108*b*) transitions from a closed inductor (fully retracted) position shown in FIG. 2, FIG. 3(*a*) and FIG. 6(*b*) through partially extended positions, one of which is shown in FIG. 3(*b*) and FIG. 6(*a*), to the opened inductor (fully extended) position shown in FIG. 4 and FIG. 5, flexible electrically conductive triple-hinged apparatus sections 116' and 116" transition from a Z-axis aligned orientation to a folded Y-axis aligned orientation as shown, for example, in FIG. 2 (closed) and FIG. 5 (opened). Suitable mechanical operators (not shown in the figures) are provided to move the inductor side extension/retraction apparatus between the Z-axis aligned orientation and the folded Y-axis aligned orientation. The mechanical operators can be connected either to one or more moveable coil sections and/or the side inductor extension/retraction apparatus.

Figure 12A:
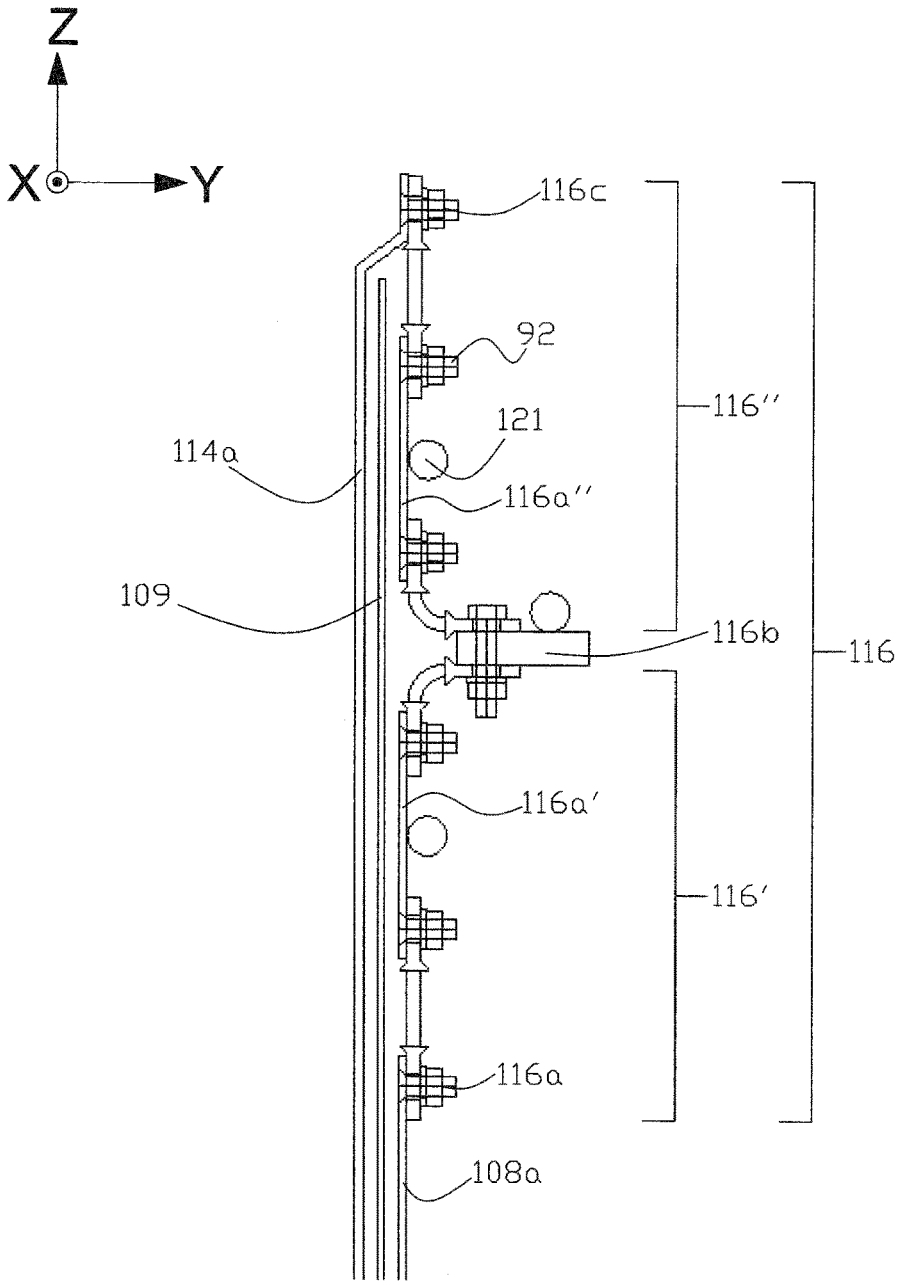
FIG. 12(*a*) through FIG. 12(*c*) illustrate detailed partial views of one example of an inductor side extension/retraction apparatus is used in the present invention in the fully retracted (closed) position, partially extended position (between the closed and opened positions) and fully extended (opened) position, respectively.
Figure 12B:
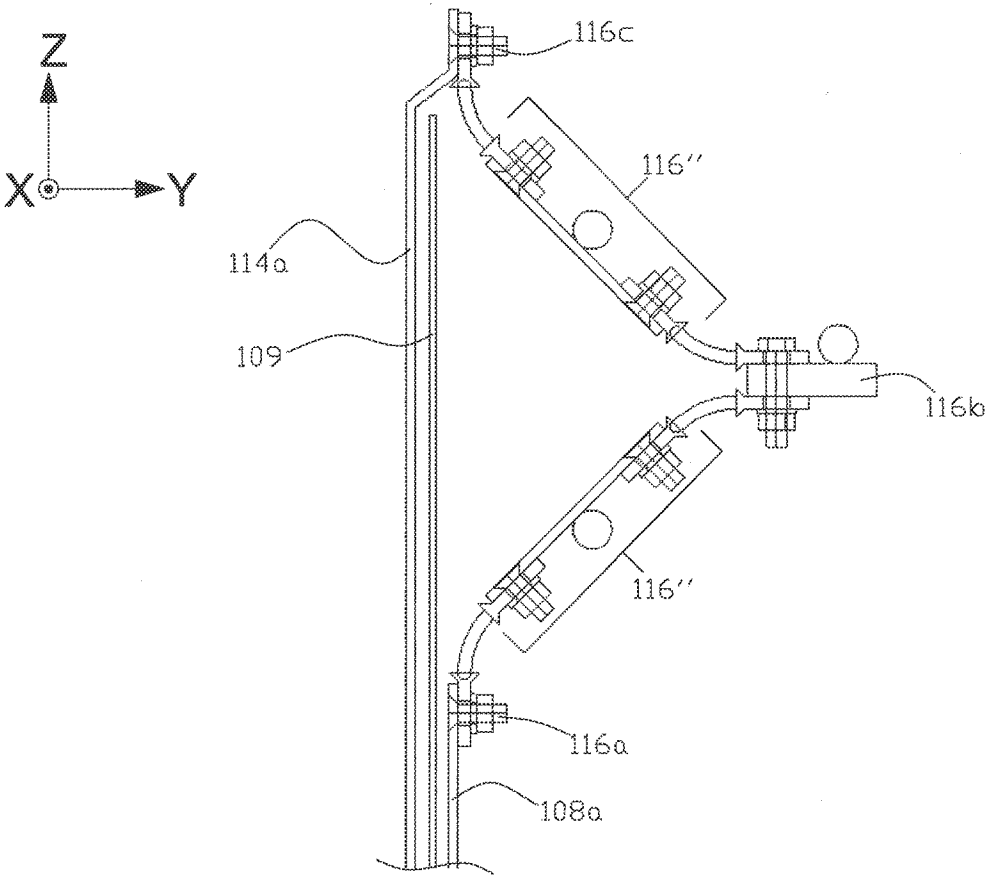
Figure 12C:
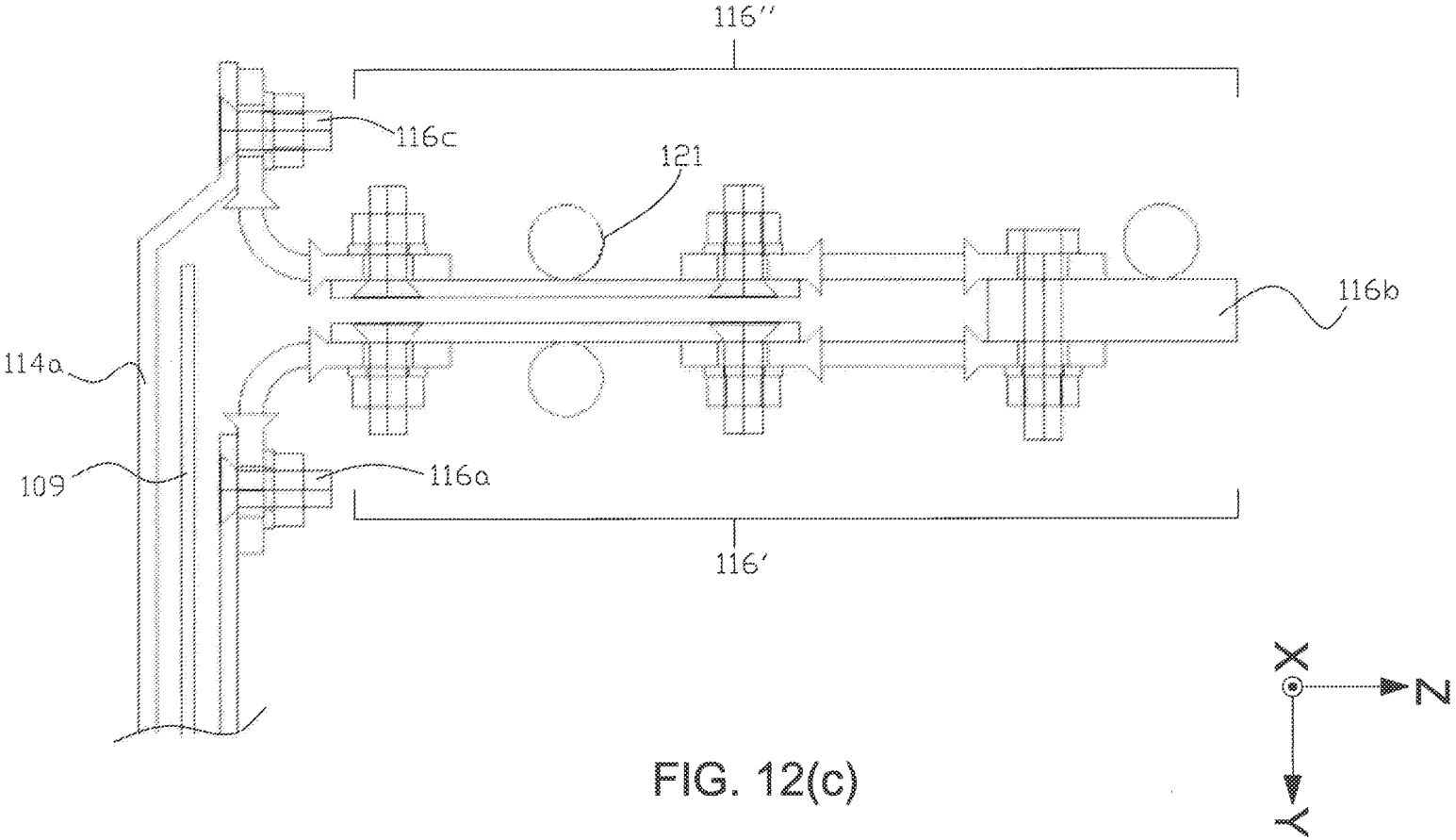

FIG. 12(*a*) through FIG. 12(*c*) illustrate one detailed embodiment of wye configured inductor side extension/retraction apparatus 116. Interconnecting each of the three joints 116*a*, 116*b* and 116*c* are electrical conductors 118*a*' and electrical conductors 118*b*' as shown, for example in FIG. 6(*a*), which may be rigid or flexible, or combination thereof, electrical conductors as required by a particular application of the invention. Suitable fasteners are provided to connect conductors 118*a*' and 118*b*' together and to connect the inductor side extension/retraction apparatus to outer fixed sheet inductor section 114*a* and inner moveable sheet inductor section 108*a*. In the embodiment of the invention shown in FIG. 12(*a*) through FIG. 12(*c*) the fasteners are interconnecting nuts and bolts. This embodiment of the inductor side extension/retraction apparatus 116 is referred to as a wye configuration since in the partially open or closed position shown in FIG. 12(*b*) apparatus 116 is wye-shaped as shown by the icon in the figure. In the fully retracted (closed) position in FIG. 12(*a*) the "arms" of the wye "open" to a vertical orientation as shown by the icon in the figure and in the fully extended (opened) position in FIG. 12(*c*) the "arms" of the wye "close" to a horizontal orientation as shown by the icon in the figure.

In other embodiments of the invention the inductor side extension/retraction apparatus may comprise any number of joints and thus can be referred to as a multi jointed flexible apparatus.

In some embodiments of the invention the width of electrical conductors 118*a*' and 118*b*' can extend across the longitudinal length of the rectangular sheet inductor. In other examples of the invention, inductor side extension/retraction apparatus 115 comprises a plurality of inductor side extension/retraction apparatus 116 as shown, for example, in FIG. 6(*a*) and FIG. 6(*b*). In this arrangement flexible electrical conductors 118*a*' and 118*b*' can comprise sheet electrical conductors as shown in FIG. 6(*a*) and FIG. 6(*b*) between all multi joints or a plurality of interconnected electrically conductive strip assemblies as shown, for example, in FIG. 12(*a*) with interconnecting fasteners 92 and electrical conducting bars 116*a*' and 116*a*" as shown in FIG. 12(*a*) through FIG. 12(*c*). Cooling medium tubing 121 (shown in cross section, for example, FIG. 12(*a*) through FIG. 12(*c*) can be optionally attached to the side inductor extension/retraction apparatus.

In some examples of the invention, movement of the inductor from the closed (fully retracted) to the opened (fully extended) position may be required to allow the abnormal region of material 90 to pass through the interior of the inductor without inductively heating the abnormal region of the material and inductively heating the material passing through the inductor only when it is in the closed (fully retracted) position or a partially extended position.

Suitable single phase alternating current power source can be provided to the rectangular sheet inductor shown in FIG. 2 through FIG. 6(*b*), for example, at side inductor power terminals PS1 and PS2 in FIG. 2, FIG. 4, FIG. 6(*a*) and FIG. 6(*b*) where the two side inductor power terminals are separated from each other via suitable electrical insulation 117 and feed power to the rectangular sheet inductor 100 through outer fixed sheet inductor section 114*b*. In other embodiments of the invention electric power can be fed to the inductor via any of the other inductor sections or sides.

In other examples of the invention, movement of the opposing side moveable inductor sections 108*a* and 108*b* from the closed (fully retracted) position to the opened (fully extended) position may be used to accommodate a variable load impedance, for example, when the material comprises a multiphase steel with varied austenite (non-magnetic) and ferrite (magnetic) content. For the embodiment of the invention shown in FIG. 2 through FIG. 6(*b*) non-magnetic regions of the material would require top inductor section 106 to be positioned closer to the surface of material 90 passing through the inductor, and magnetic regions of the material would require the top inductor section to be positioned farther away from the surface of material 90 passing through the inductor to achieve an even level of heating as the material passes through the variable interior opening of the inductor. In these embodiments making only the top section of the inductor moveable destroys top and bottom symmetrical induction heating of the material passing through the inductor unless material mechanical reposting apparatus is provided to re-center the material between the top and bottom inductor sections within the changing interior furnace volume. Alternatively in other examples of the invention a moveable bottom inductor section that is a mirror image of the top inductor section can be provided for the bottom inductor section so that the material remains symmetrically spaced apart from the top and bottom sections of the inductor while the material passes through the inductor.

Figure 7:
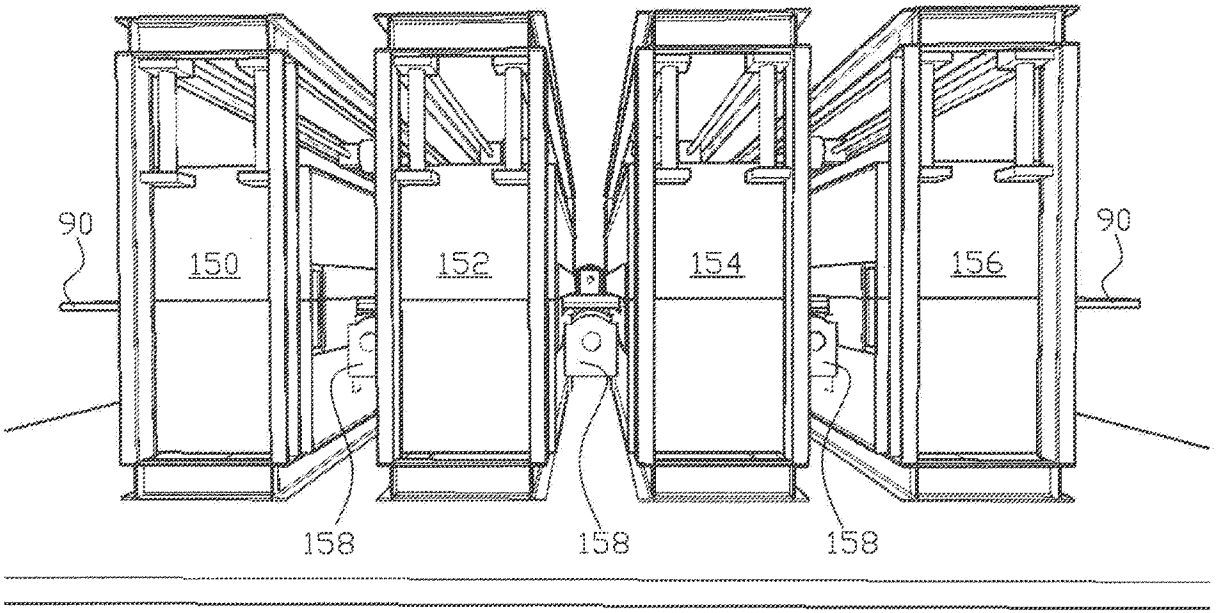
FIG. 7 is a perspective view of the inductor shown in FIG. 6(*a*) and FIG. 6(*b*) installed in each one of four enclosures in an induction furnace heating line for a strip or slab material.

FIG. 7 illustrates the rectangular sheet inductor shown in FIG. 6(*a*) and FIG. 6(*b*) installed within each one of enclosures 150, 152, 154 and 156 to form an induction furnace heating line for a strip or slab material 90 with material support and conveyor apparatus 158 installed between each enclosure to support and move the material through the induction furnace heating line. In operation material 90 passes through each rectangular sheet inductor 100 within the enclosures while alternating current is supplied to the inductors and the variable cross sectional interior opening of each inductor is at a nominal process material cross sectional interior opening. When a variable material parameter (that is, a material shape abnormality or change in electromagnetic properties of the material is sensed with a suitable sensing device) the variable cross sectional interior opening of one or more of the inductors will increase or decrease to accommodate the variable material parameter.

Figure 8A:
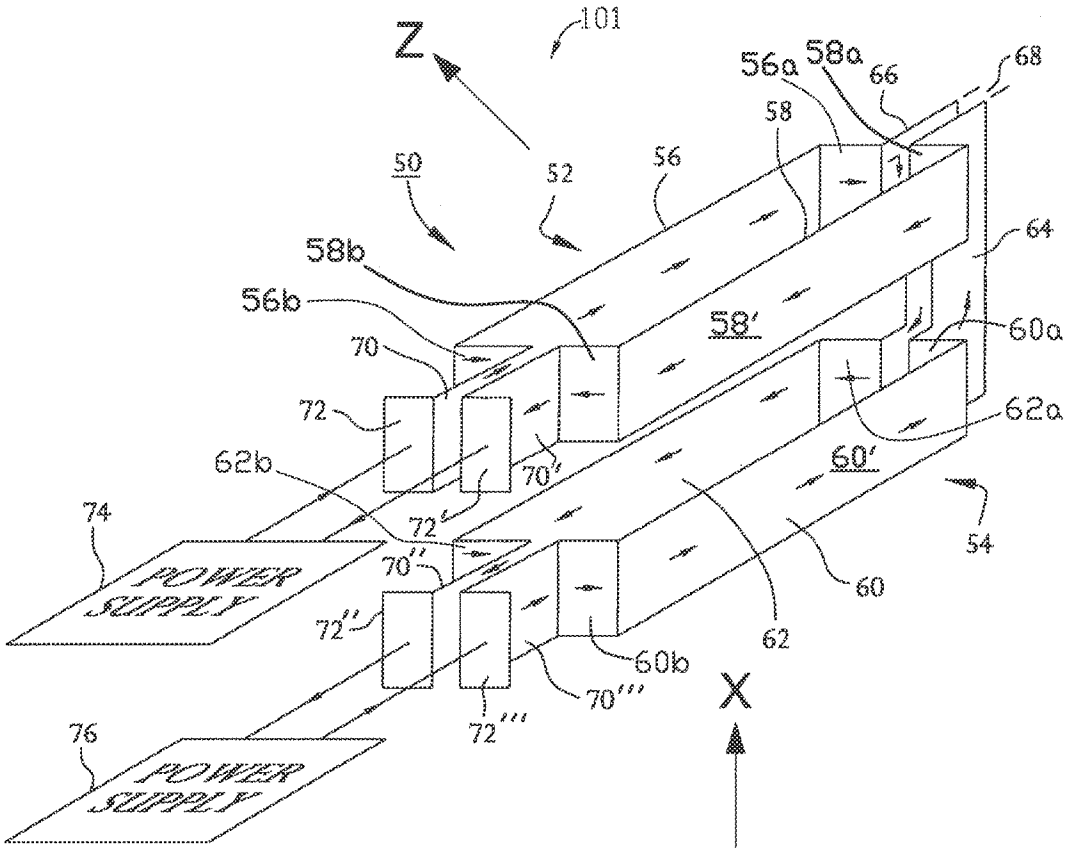
FIG. 8(*a*) is a perspective view of a prior art two-turn solenoidal coil apparatus for heating continuous strip material with gap 68 to allow a metallic strip to easily pass through the gap 68 to move it into and remove it from the heating position within the coil apparatus.
Figure 8B:
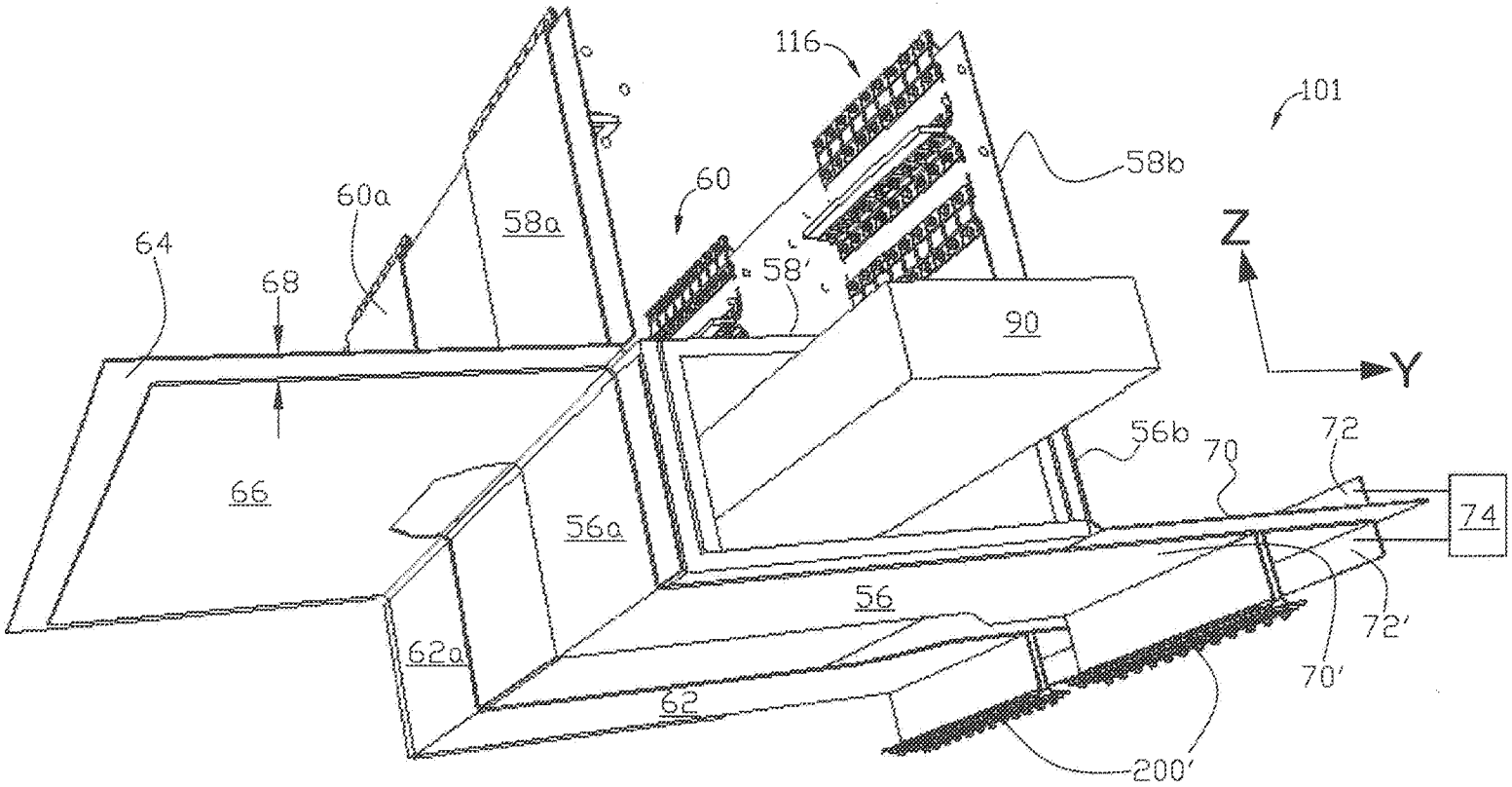
Figure 8C:
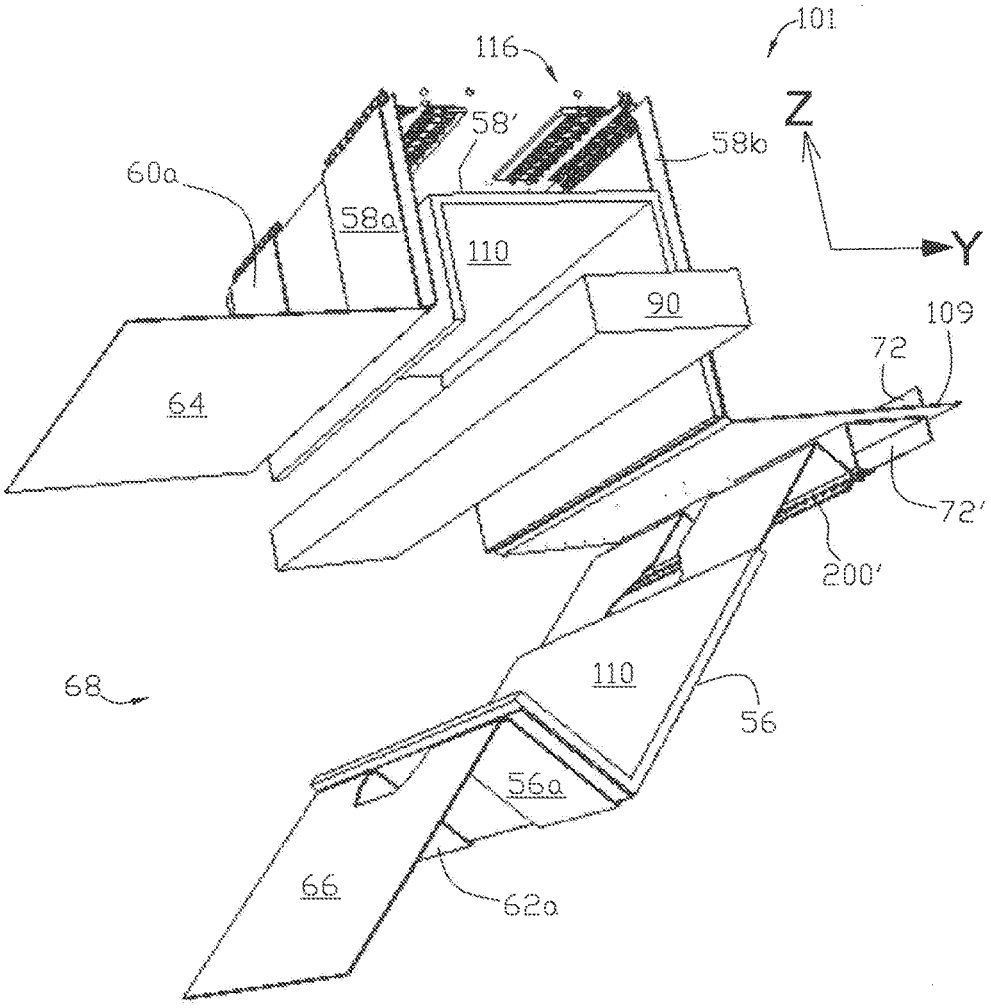
Figure 9:
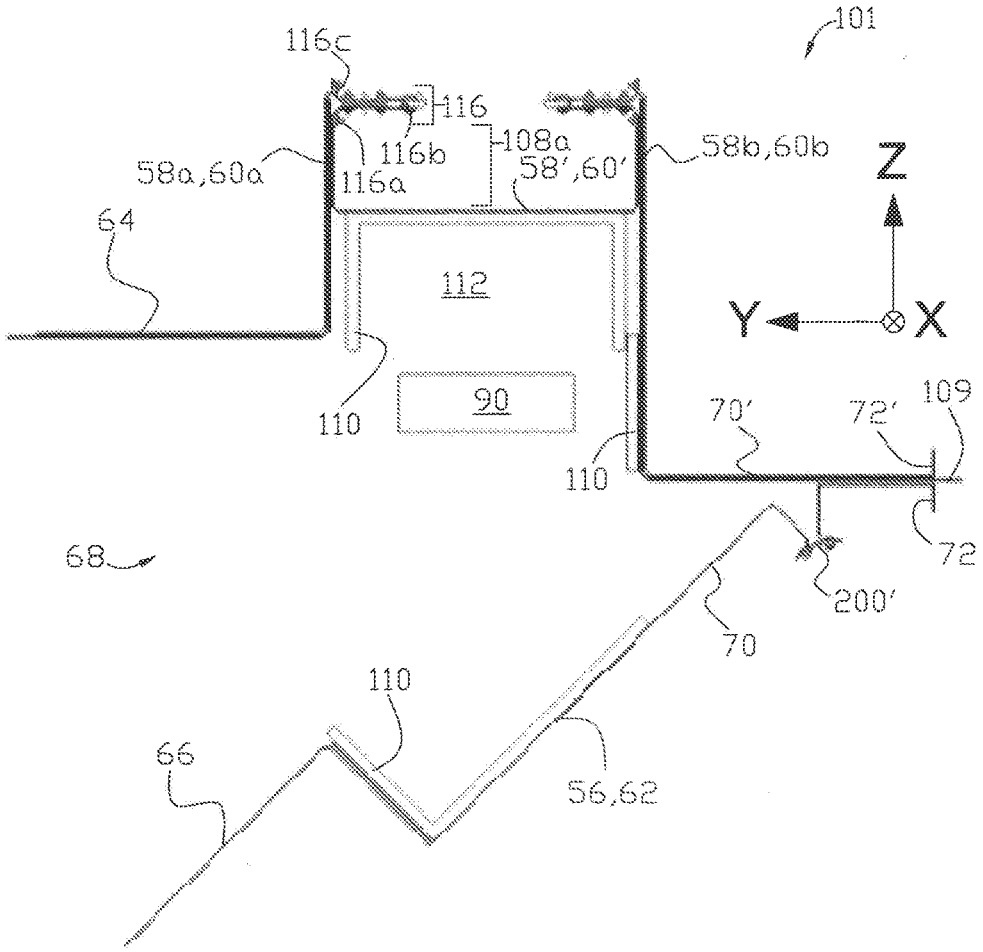
FIG. 9 is a cross sectional elevation of the inductor shown in FIG. 8(*c*) in the inductor open position for passage of an abnormal region of the strip or slab material passing through the interior of the inductor and with the moveable inductor sections shown in the retracted position.

FIG. 8(*a*) illustrates a prior art coil apparatus that functions as a two-turn rectangular sheet inductor as disclosed in U.S. Pat. No. 5,837,976 ("the '976 patent") which is incorporated herein by reference in its entirety. For convenience in this specification reference numbers used in the '976 patent are also used in this specification. FIG. 8(*a*) herein is FIG. 2 in the '976 patent as modified with the improvement of two pairs of adjustable first and second opposing inductor sides, namely first pair of opposing inductor sides 58*a* and 58*b* and second pair of opposing inductor sides 60*a* and 60*b* as annotated in FIG. 8(*a*) and further disclosed herein.

Figure 10:
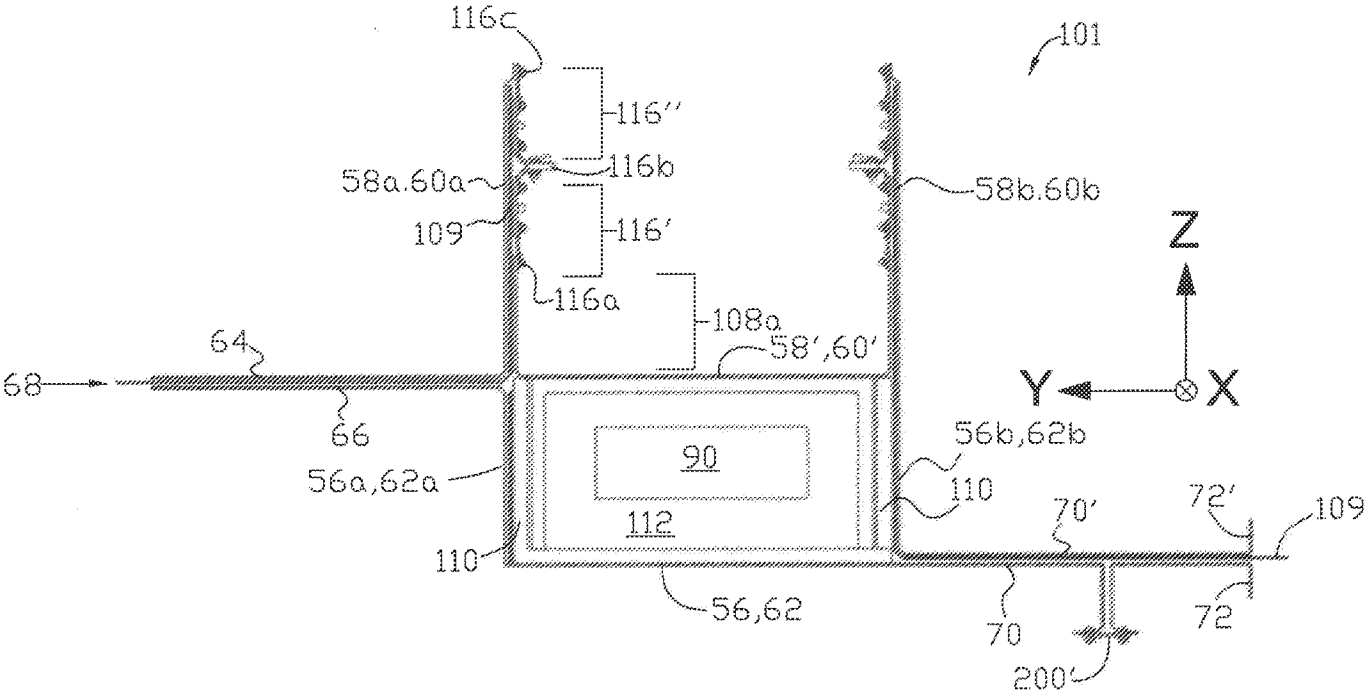
FIG. 10 is a cross sectional elevation of the inductor shown in FIG. 8(*b*) in the closed position for passage of the material through the interior of the inductor and with the moveable top inductor sections shown in the closed (fully retracted) position.

With reference to FIG. 8(*b*) through FIG. 10 herein there is shown another embodiment of a rectangular sheet inductor 101 of the present invention that has a variable cross sectional interior opening and is configured as a two-turn rectangular sheet inductor having first inductor section 52 and second inductor section 54. Each inductor section comprises first and second complementary half-turns, namely first and second complementary half-turns 56 and 58, and first and second complementary half-turns 62 and 60, that form an effective full-turn inductor through which material 90 may pass. The inductor sections 52 and 54 are arranged longitudinally separated from each other in the direction of the path of material 90 through rectangular sheet inductor 101, with the first half-turn 56 of the first inductor section 52 and the first half-turn 62 of the second inductor section 54 being connected at one end of the inductor by a first shunt conductor 66, and the second half-turn 58 of the first inductor section 52 being likewise connected at the same one end of the inductor to the second half-turn 60 of the second inductor section 54 by a second shunt conductor 64. The shunt conductors 66 and 64 are separated from each other by a gap 68 of sufficient dimension to permit material 90 to be positioned in and removed from the inductor edgewise through gap 68 formed in the one end of the inductor.

Rectangular sheet inductor 101 further comprises first 74 and second 76 alternating current power supplies each with two terminals for connection to inductor, the first power supply 74 being connected at its first terminal 72 to the first half-turn 56 of the first inductor section 52 via fixed inductor sections 70 and 56*a* and at the other terminal 72' to the second half-turn 58 of the first inductor section 52 via fixed inductor section 70' and adjustable second opposing side 58*b* of the first adjustable first and second opposing sides 58*a* and 58*b*, with the connection being made at the end of the inductor opposite to the end having the shunt conductors. The second power supply 76 is connected at its first terminal 72" to the first half-turn 62 of the second inductor section 54 via fixed inductor sections 70" and 62*b* and at the other terminal 72"' to the second half-turn 60 of the second inductor section via fixed inductor section 70"' and adjustable second opposing side 60*b* of the second adjustable first and second opposing inductor sides 60*a* and 60*b*. The connection of the two power supplies to the inductor 101 form a series electrical circuit for current passing through inductor 101 at a given instant from the first power supply 74 through the first half-turn 56 of the first inductor section 52, through shunt conductor 66 and the first half-turn 62 of the second inductor section 54 into the second power supply 76, then from the second power supply 76 into the second half-turn 60 of the second inductor section 54 through shunt conductor 64 to the second half-turn of the first inductor section 58 and returning to the first power supply 74, with the current reversing its direction at another instant corresponding to an opposite cycle of the alternating current power supplies.

Each of the pair of first adjustable first 58*a* and second 58*b* opposing inductor sides and second adjustable first 60*a* and 60*b* opposing inductor sides are as disclosed above with each opposing inductor side comprising an outer fixed sheet inductor section and an inner moveable sheet inductor section with the first ends of the outer fixed sheet inductor sections of the first adjustable first and second opposing sides connected to the opposing ends of the fixed inductor sides 64 (shunt conductor) and 70' and the first ends of the inner moveable sheet inductor sections of the first adjustable first and second opposing sides connected to the opposing ends of the moveable inductor side 58'. Similarly for the second adjustable first 60*a* and second 60*b* opposing inductor sides the first ends of the outer fixed sheet inductor sections of the second adjustable first and second opposing sides are connected to the opposing ends of the fixed inductor sides 64 and 70"' and the first ends of the inner moveable sheet inductor sections of the second adjustable first and second opposing inductor sides connected to the opposing ends of the moveable inductor side 60'. Similar to previous embodiments of the invention a separate inductor side extension/retraction apparatus is provided for connecting a second end of the outer fixed sheet inductor section and a second end of the inner moveable sheet inductor section of each of the pair of adjustable first and second opposing sides 58*a*-58*b* and 60*a*-60*b*. With this adjustable arrangement the pair of first adjustable first 58*a* and second 58*b* opposing inductor sides and second adjustable first 60*a* and 60*b* opposing inductor sides can extend or retract moveable inductor sides 58' and 60' to permit material with a variable material parameter to pass through a variable cross sectional opening in inductor sections 52 and 54.

In some embodiments of the two-turn inductor 101 illustrated in FIG. 8(*b*) through FIG. 10 in addition to the being able to making inductor sides 58 and 60 moveable to increase or decrease the cross sectional interior opening of inductor 101, the connection between power supplies 74 and 76 and inductor turns 52 and 54 can include at least at least one electrically conductive flexible element 200' similar to flexible element 200 disclosed in FIG. 10*b* of the '976 patent.

Alternatively in other examples of the present invention shown in FIG. 8(*b*) through FIG. 10 herein lower fixed inductor sections 56 and 62 can be moveable lower inductor sections that are mirror image of the upper moveable inductor sections 58' and 60' so that the material passing through the rectangular sheet inductor remains symmetrically spaced apart from the upper and lower sections of the rectangular sheet heating inductor when the inductor while the material passes through the inductor.

Figure 11A:
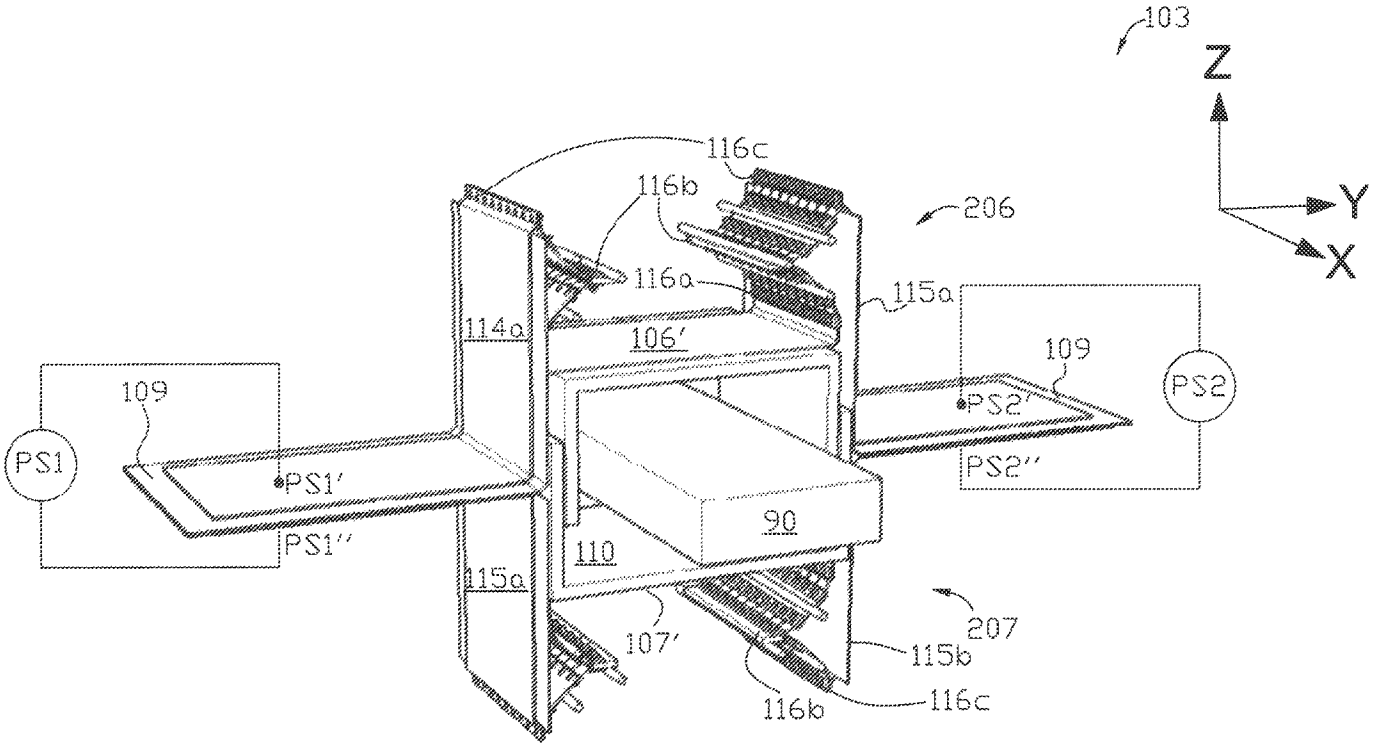
FIG. 11(*a*) is a perspective view of another example of a rectangular sheet inductor of the present invention where the rectangular sheet inductor is configured as a symmetrical half-turn inductor with moveable top and bottom inductor sections shown in a partially extended position between a closed (fully retracted) position and an opened (fully extended) position.
Figure 11B:
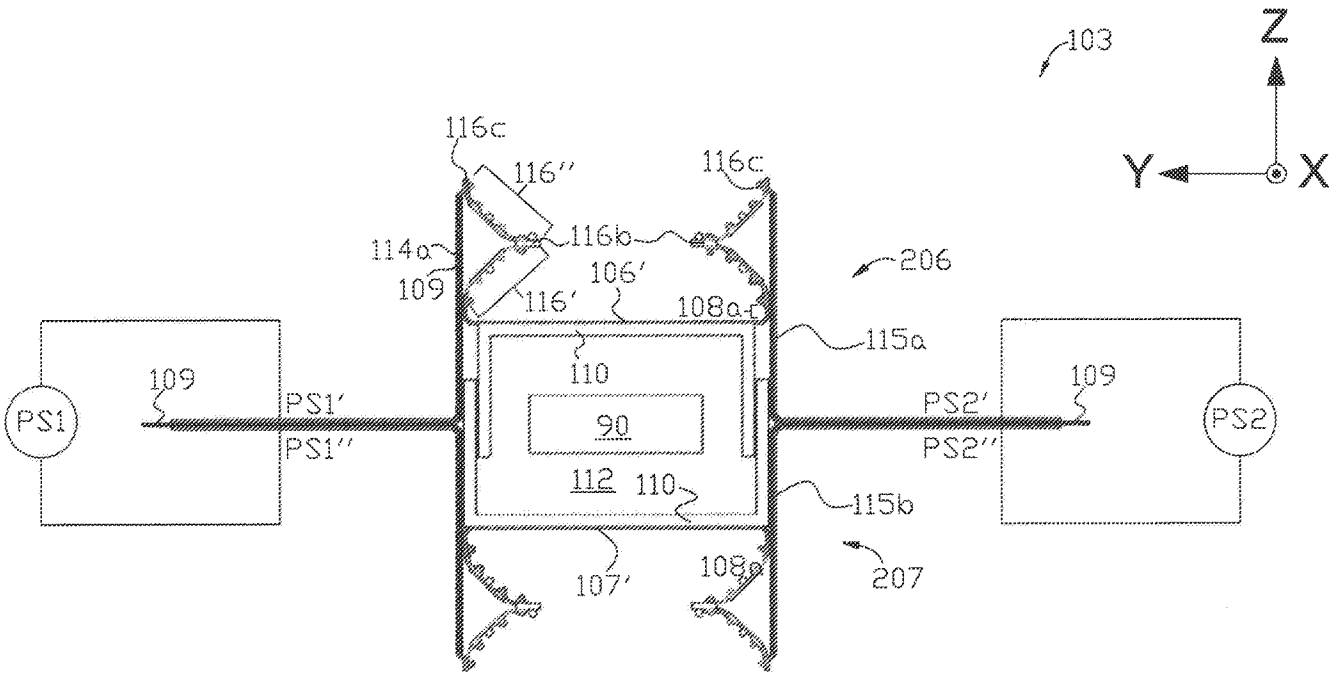
Figure 11C:
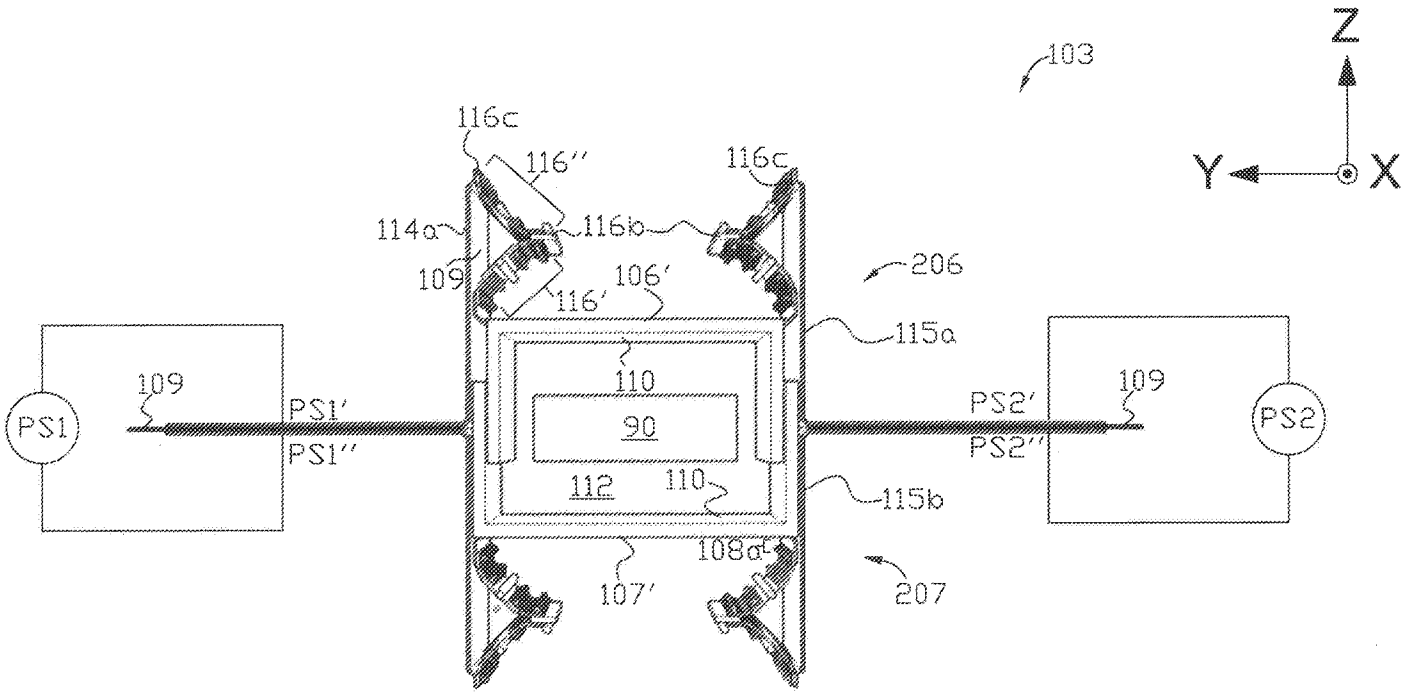

FIG. 11(*a*) through FIG. 11(*c*) illustrates another embodiment of a rectangular sheet heating inductor 103 of the present invention where the rectangular sheet inductor 103 is configured as a symmetrical half-turn inductor with upper half-turn inductor section 206 and lower half-turn inductor coil section 207 with the moveable upper 106' and lower half-turn inductor sections shown in a partially extended position between a closed (fully retracted) position and an opened (fully extended) position similar to that shown in other examples of the invention and where in order to maintain top and bottom half-turn symmetry relative to the position of material 90 within inductor, both the upper half-turn 206 and the lower half-turn 207 are provided with fixed and moveable side sections electrically interconnected via an inductor side extension/retraction apparatus as disclosed above, for example, to match varying load impedances and/or to allow an abnormal region of the strip or slab material to pass through the inductor. First alternating current source power supply PS1 is connected to the inductor 103 at the first end of the upper outer fixed sheet inductor section 114*a* via terminal PS1' and first end of the lower outer fixed sheet inductor section 115*a* via terminal PS1" and second alternating current source power supply PS2 is connected to the inductor 103 at the first end of the upper outer fixed sheet inductor section 115*a* via terminal PS2' and first end of the lower outer fixed sheet inductor section 115*b* via terminal PS2".

In the above examples of the invention a single rectangular sheet inductor or a single multi-turn inductor are described. The moveable inductor section as disclosed herein can be applied to other arrangements of one or more rectangular sheet inductors and other arrangements of multi-turn inductors.

In some examples of the invention a dynamic impedance load matching control system can be provided so that real time monitoring of changes in load impedance can be used to adjust the position of the inductor's moveable coil sections for materials such as multiphase steels.

Orientation terminology such as top, bottom and side, or upper and lower do not limit the orientation of a rectangular sheet heating inductor of the present invention and is used to simply disclosure of the various embodiments of the invention.

In the description above, for the purposes of explanation, numerous specific requirements and several specific details have been set forth in order to provide a thorough understanding of the example and embodiments. It will be apparent however, to one skilled in the art, that one or more other examples or embodiments may be practiced without some of these specific details. The particular embodiments described are not provided to limit the invention but to illustrate it.

Reference throughout this specification to "one example or embodiment," "an example or embodiment," "one or more examples or embodiments," or "different example or embodiments," for example, means that a particular feature may be included in the practice of the invention. In the description various features are sometimes grouped together in a single example, embodiment, figure, or description thereof for the purpose of streamlining the disclosure and aiding in the understanding of various inventive aspects.

The present invention has been described in terms of preferred examples and embodiments. Equivalents, alternatives and modifications, aside from those expressly stated, are possible and within the scope of the invention.

The invention claimed is:

1. A rectangular sheet heating inductor having a variable cross sectional interior opening fora passage of a material through the variable cross sectional interior opening, the rectangular sheet inductor comprising:

a fixed inductor side opposing a moveable inductor side; and an adjustable first and second opposing sides, each of the adjustable first and second opposing sides comprising an outer fixed sheet inductor section and an inner moveable sheet inductor section, a first ends of the outer fixed sheet inductor sections of the adjustable first and second opposing sides connected to an opposing ends of the fixed inductor side and a first ends of the inner moveable sheet inductor sections of the adjustable first and second opposing sides connected to the opposing ends of the moveable inductor side;

a separate inductor side extension/retraction apparatus connecting a second end of the outer fixed sheet inductor section and a second end of the inner moveable sheet inductor section of each of the adjustable first and second opposing sides, the second end of the outer fixed sheet inductor section opposing the first end of the outer fixed sheet inductor section and the second end of the inner moveable sheet inductor section opposing the first end of the inner moveable sheet inductor section, each of the separate inductor side extension/retraction apparatus comprising a multi-hinged flexible apparatus having a series connected flexible electrical conductor sections configured in a wye when the adjustable first and second opposing sides are in a partially extended side position; a horizontally oriented closed wye when the adjustable first and second opposing sides are in a fully extended side position where the variable cross sectional interior opening is at a maximum size; and a vertically oriented open wye when the adjustable first and second opposing sides are in a fully retracted side position where the variable cross sectional interior opening is at a minimum size; and a power source connection for connecting the rectangular sheet heating inductor to an alternating current source.

2. The rectangular sheet heating inductor of claim 1 wherein the multi-hinged flexible apparatus further comprises:

a first hinged joint connecting the multi-hinged flexible apparatus to the second end of the outer fixed sheet inductor section with a first suitable fastener;

a second hinged joint connecting the multi-hinged flexible apparatus to the second end of the inner moveable sheet inductor section with a second suitable fastener; and a third hinged joint connecting the first and second hinged joints with a third suitable fastener via one or more flexible electrical conductors between the third and first hinged joints and the third and second hinged joints.

3. The rectangular sheet heating inductor of claim 2 wherein the one or more flexible electrical conductors comprise an interconnected flexible conducting cables and/or an electrically conducting strips and a plurality of the multi-hinged flexible apparatus forming at least one of the separate inductor side extension/retraction apparatus.

4. The rectangular sheet heating inductor of claim 2 wherein a plurality of the multi-hinged flexible apparatus form at least one of the separate inductor side extension/retraction apparatus and the one or more flexible electrical conductors comprises an electrically conductive sheet.

5. A rectangular sheet heating inductor having a variable cross sectional interior opening fora passage of a material through the variable cross sectional interior opening, the rectangular sheet heating inductor comprising:

a first (52) inductor section and a second inductor section (54), each of the first and second inductor sections comprising first complementary half-turns and a second complementary half-turns (56/58, 62/60) forming an effective two-turn inductor through which the material may pass, wherein the first and second inductor sections (52, 54) are arranged longitudinally separated from each other in the direction of the path of the material through the rectangular sheet heating inductor, the first half-turn (56) of the first inductor section (52) and the first half-turn (62) of the second inductor section (54) being connected at one end of the rectangular sheet heating inductor by a first shunt conductor (66) respectively via first and second fixed inductor opposing sides (56*a*) and (62*a*), the second half-turn (58) of the first inductor section (52) being likewise connected at the same one end of the rectangular sheet heating inductor to the second half-turn (60) of the second inductor section (54) by a second shunt conductor (64) via first and second adjustable inductor opposing sides (58*a*) and (60*a*), the first and second shunt conductors (66, 64) being separated from each other by a gap (68) of a dimension to permit the material to be positioned in and removed from the rectangular sheet heating inductor edgewise through the gap (68) formed in the one end of the rectangular sheet heating inductor;

a first alternating current power supply (74) and a second alternating current power supply (76) each having two terminals for connection to the rectangular sheet heating inductor, the first alternating current power supply (74) being connected at a first supply first terminal (72) to the first half-turn (56) of the first inductor section (52) via fixed inductor section (56*b*) and at a first supply second terminal (72') to the second half-turn (58) of the first inductor section (52) via a first adjustable first opposing side (58*b*) via fixed inductor side (70'), the connection being made at the end of the rectangular sheet heating inductor opposite to the end having the first and second shunt conductors (66, 64), the second alternating current second power supply (76) likewise being connected at a second supply first terminal (72") to the first half-turn (62) of the second inductor section (54) via fixed inductor section (62*b*) and at a second supply second terminal (72'") to the second half-turn (60) of the second inductor section (54) via an adjustable second opposing side; the connection of the first and second alternating current power supplies to the rectangular sheet heating inductor forming a series electrical circuit for an alternating current passing through the rectangular sheet heating inductor at a given instant from the first alternating current power supply through the first half-turn (56) of the first inductor section (52), through the first shunt conductor (66) and the first half-turn (62) of the second inductor section (54) into the second alternating current power supply (76), then from the second alternating current power supply into the second half-turn (60) of the second inductor section (54) through the second shunt conductor (64) to the second half-turn (58) of the first inductor section (52) and returning to the first alternating current power supply (74), the alternating current reversing its direction at another instant corresponding to an opposite cycle of the alternating current power supplies; and the first adjustable first (58*a*) and second (58*b*) opposing adjustable inductor sides connected to opposing ends of inductor section (58') and the second adjustable first (60*a*) and second (60*b*) opposing adjustable inductor sides connected to opposing ends of inductor section (60') making inductor sections (58', 60') a pair of movable inductor sections.

6. The rectangular sheet heating inductor of claim 5 wherein each of the first and second adjustable first and second opposing adjustable inductor sides includes a separate multi-hinged flexible apparatus comprising:

a first hinged joint connecting the multi-hinged flexible apparatus to the second end of an outer fixed sheet inductor section with a first suitable fastener;

a second hinged joint connecting the multi-hinged flexible apparatus to the second end of an inner moveable sheet inductor section with a second suitable fastener; and a third hinged joint connecting the first and second hinged joint with a third suitable fastener via one or more flexible electrical conductors between the third and first hinged joints and the third and second hinged joint.

7. The rectangular sheet heating inductor of claim 6 wherein the one or more flexible electrical conductors comprise an interconnected flexible conducting cables and/or an electrically conducting strips and a plurality of the multi-hinged flexible apparatus forming at least one of the separate inductor side extension/retraction apparatus.

8. The rectangular sheet heating inductor of claim 6 wherein a plurality of the multi-hinged flexible apparatus form at least one of the separate inductor side extension/retraction apparatus and the one or more flexible electrical conductors comprises an electrically conductive sheet.

9. The rectangular sheet heating inductor of claim 6, wherein the first supply first and second terminals and the second supply first and second terminals comprises at least one electrically conductive flexible element.

10. A rectangular sheet heating inductor having a variable cross sectional interior opening fora passage of a material through the variable cross sectional interior opening, the rectangular sheet inductor comprising:

a first moveable inductor side;

a first adjustable first and second opposing sides, each of the first adjustable first and second opposing sides comprising an outer fixed sheet inductor section and an inner moveable sheet inductor section, a first ends of the inner moveable sheet inductor sections of the first adjustable first and second opposing sides connected to the opposing ends of the first moveable inductor side;

a second moveable inductor side;

a second adjustable first and second opposing sides, each of the first adjustable first and second opposing sides comprising an outer fixed sheet inductor section and an inner moveable sheet inductor section, a first ends of the inner moveable sheet inductor sections of the second adjustable first and second opposing sides connected to the opposing ends of the second moveable inductor side; and a separate inductor side extension/retraction apparatus connecting a second end of the outer fixed sheet inductor section and a second end of the inner moveable sheet inductor section of each of the first and second adjustable first and second opposing sides, the second end of the outer fixed sheet inductor section opposing the first end of the outer fixed sheet inductor section and the second end of the inner moveable sheet inductor section opposing the first end of the inner moveable sheet inductor section, each of the separate inductor side extension/retraction apparatus comprising a multi-hinged flexible apparatus having a series connected flexible electrical conductor sections configured in a wye when the first and second adjustable first and second opposing sides are in a partially extended side position; a horizontally oriented closed wye when the first and second adjustable first and second opposing sides are in a fully extended side position where the variable cross sectional interior opening is at a maximum size; and a vertically oriented open wye when the first and second adjustable first and second opposing sides are in a fully retracted side position where the variable cross sectional interior opening is at a minimum size;

a first ends of the outer fixed sheet inductor sections of the first adjustable first and second opposing sides connected respectively to a first power terminal and a second power terminal for connection to a first outputs of a first alternating current power source and a second alternating current power source respectively; and a first ends of the outer fixed sheet inductor sections of the second adjustable first and second opposing sides connected respectively to a third and a fourth power terminal for connection to a second outputs of the first alternating current power source and the second alternating current power source respectively.

11. The rectangular sheet inductor of claim 10 wherein the multi-hinged flexible apparatus further comprises:

a first hinged joint connecting the multi-hinged flexible apparatus to the second end of the outer fixed sheet inductor section with a first suitable fastener;

a second hinged joint connecting the multi-hinged flexible apparatus to the second end of the inner moveable sheet inductor section with a second suitable fastener; and a third hinged joint connecting the first and second hinged joint with a third suitable fastener via one or more flexible electrical conductors between the third and first hinged joints and the third and second hinged joint.

12. The rectangular sheet inductor of claim 11 wherein the one or more flexible electrical conductors comprise an interconnected flexible conducting cables and/or an electrically conducting strips and a plurality of the multi-hinged flexible apparatus forming at least one of the separate inductor side extension/retraction apparatus.

13. The rectangular sheet inductor of claim 11 wherein a plurality of the multi-hinged flexible apparatus form at least one of the separate inductor side extension/retraction apparatus and the one or more flexible electrical conductors comprises an electrically conductive sheet.

14. A method of accommodating a material parameter variation in a strip or a slab material in a strip or slab material heating line or a varying electromagnetic properties of the strip or the slab material, the method comprising:

passing the strip or slab material through a rectangular sheet inductor having a variable cross sectional interior opening while supplying an alternating current to the rectangular sheet inductor with the variable cross sectional interior opening at a nominal material cross sectional interior opening, where the rectangular sheet inductor comprises:

a fixed inductor side opposing a moveable inductor side; and an adjustable first and second opposing sides, each of the adjustable first and second opposing sides comprising an outer fixed sheet inductor section and an inner moveable sheet inductor section, a first ends of the outer fixed sheet inductor sections of the adjustable first and second opposing sides connected to an opposing ends of the fixed inductor side and a first ends of the inner moveable sheet inductor sections of the adjustable first and second opposing sides connected to the opposing ends of the moveable inductor side; and a separate inductor side extension/retraction apparatus connecting a second end of the outer fixed sheet inductor section and a second end of the inner moveable sheet inductor section of each of the adjustable first and second opposing sides, the second end of the outer fixed sheet inductor section opposing the first end of the outer fixed sheet inductor section and the second end of the inner moveable sheet inductor section opposing the first end of the inner moveable sheet inductor section, each of the separate inductor side extension/retraction apparatus comprising a multi-hinged flexible apparatus having a series connected flexible electrical conductor sections configured in a wye when the adjustable first and second opposing sides are in a partially extended side position; a horizontally oriented closed wye when the adjustable first and second opposing sides are in a fully extended side position where the variable cross sectional interior opening is at a maximum size; and a vertically oriented open wye when the adjustable first and second opposing sides are in a fully retracted side position where the variable cross sectional interior opening is at a minimum size;

sensing the material parameter variation or the varying electromagnetic properties of the strip or the slab material; and increasing or decreasing the variable cross sectional interior opening to accommodate the material parameter variation or the varying electromagnetic properties prior to the strip or the slab material passing through the rectangular sheet inductor.

* * * * *